US005721465A

United States Patent [19]

Roberts

[11] Patent Number: 5,721,465

[45] Date of Patent: Feb. 24, 1998

[54] XENON ARC LAMP WITH IMPROVED REFLECTOR COOLING

[75] Inventor: Roy D. Roberts, Newark, Calif.

[73] Assignee: ILC Technology, Inc., Sunnyvale, Calif.

[21] Appl. No.: 702,026

[22] Filed: Aug. 23, 1996

[51] Int. Cl.[6] ..... H01J 1/02

[52] U.S. Cl. ..... 313/46; 313/39; 313/113; 313/246; 313/570; 313/634

[58] Field of Search ..... 313/46, 39, 110, 313/111, 113, 246, 570, 634, 355, 631, 632, 35; 361/688, 694, 704, 707

[56] References Cited

U.S. PATENT DOCUMENTS

| | | | |
|---|---|---|---|
| 4,599,540 | 7/1986 | Roberts | 313/113 |
| 5,299,279 | 3/1994 | Roberts | 313/113 X |
| 5,399,931 | 3/1995 | Roberts | 313/113 X |
| 5,561,338 | 10/1996 | Roberts et al. | 313/46 |

*Primary Examiner*—Ashok Patel

*Attorney, Agent, or Firm*—Law Offices of Thomas E. Schatzel A Prof. Corporation

[57] ABSTRACT

A xenon arc lamp comprises a cylindrical ceramic body in which an elliptical reflector is molded to have a diameter of about 1.4 inches. The ends each have metal electrical contact rings, one for the anode and one for the cathode. The body has two different diameters with a step in between at the middle that is formed into the ceramic. A standardized anode heat sink for lesser-powered conventional one inch modular lamp bases is fitted to the base and makes thermal contact to the ledge underside of the step in the ceramic. Thus two dissimilar orthogonal heat transfer interfaces are formed, one radial which is metal to metal, and one axial which is ceramic to metal. A standardized cathode heat sink for the same lesser-powered conventional one inch modular lamp bases is relieved for about half of its inside length to accommodate the 1.4 inch reflector diameter and is fitted to the front.

3 Claims, 3 Drawing Sheets

XENON ARC LAMP WITH IMPROVED REFLECTOR COOLING

BACKROUND OF THE INVENTION

1. Field of the Invention

The invention relates generally to arc lamps and specifically to arc lamps that improve the cooling of the internal light reflector.

2. Description of the Prior Art

The high power xenon arc lamp market has been pressing lamp manufacturers with two diametrically opposed goals, compactness and high power. Several manufacturers make, more-or-less, a standard lamp holder and module assembly that has found wide acceptance. Newer higher powered lamps must fit the constraints of such standardized modules if they are to have any chance of commercial success. The present inventor, Roy D. Roberts, and one other, John Kiss, filed an earlier United States Patent Application that describes a one inch diameter elliptical lamp capable of three hundred watt operation. Present requirements have pushed the power requirements to five hundred watts, and such lamps must run cool enough so that thousand hour lives are possible.

One illustration of the present inventor's previous patent application is included here. FIG. 1 illustrates a lamp system 10 that comprises a drop-in lamp assembly 12 that includes a spectral filter assembly 13, an arc lamp 14 having a cathode ring 15 and an anode ring 16, a cathode heat sink 18, an anode heat sink 20 and an insulative housing 22. The insulative housing 22 has a pair of bushings 24 and 26 through which metal fasteners are used to mechanically secure each of the heat sinks 18 and 20 while maintaining their electrical isolation from one another. The housing 22 further includes finger-pull recesses 28 and 29 for a user's ease of withdrawing the drop-in lamp assembly 12 from a drop-in receptacle 30.

The drop-in receptacle 30 includes a fan 32 mounted to the back end of a metal-wall housing 34. The drop-in receptacle 30 is suitable for flush mounting in a flat area. The finger pulls 28 and 29 make it practical to use such flush mountings, given the frequent need to replace short-lived arc lamps 14. The fan 32 operates to force about twenty-five to thirty CFM of cool outside air through a hole 36 directly to the radial fins of the heat sinks 18 and 20. In some cases, it is preferable to use two fans 32 mounted in series face-to-back or parallel to overcome any airflow resistance that may exist through the heat sinks 18 and 20. The metal-wall housing 34 comprises a plurality of tabs 37 that are used with fasteners to attach the housing 22, and a plurality of tabs 38 that are also used with fasteners to attach to a glass epoxy board 40. The glass epoxy board 40 provides mechanical support and insulation for a cathode terminal 42 that electrically engages the cathode heat sink 18 and the cathode ring 15, and an anode terminal 44 that electrically engages the anode heat sink 20 and the anode ring 16. The hole 36 in the housing 34 allows air from the fan 32 to be axially directed from the outside to the heat sinks 20 and 18, respectively. High-voltage direct current power is applied to the system 10 through electrical cables that are permanently wired to the terminals 42 and 44.

When operated at high temperatures caused by high power operation, conventional high wall-loaded metal halide lamps for projection suffer from a chemical attack of their quartz walls which cause devitrification. With as little as 500 hours use, such devitrification can severely diffuse the arc image and reduce projector efficiency to unacceptable levels. Metal halide lamps operated at lower wall-loads typically survive many thousand hours of use, but are not commonly used in video projector applications because their universally larger size is impractical in compact optical systems. The warm-up times that such lamps require to reach usable brightness will test most users' patience.

SUMMARY OF THE PRESENT INVENTION

It is therefore an object of the present invention to provide an extended-power xenon arc lamp.

It is another object of the present invention to provide an arc lamp that can operate at power levels exceeding 500 watts, and yet still fit into modular assemblies originally intended for 300 watt lamps.

It is a further object of the present invention to provide an arc lamp that has increased life by lowering the operating temperatures.

Briefly, a xenon arc lamp embodiment of the present invention comprises a cylindrical ceramic body in which an elliptical reflector is molded to have a diameter of about 1.4 inches. The ends each have metal electrical contact rings, one for the anode and one for the cathode. The body has two different diameters with a step in between at the middle that is formed into the ceramic. A standardized anode heat sink for lesser-powered conventional one inch modular lamp bases is fitted to the base. A standardized cathode heat sink for the same lesser-powered conventional one inch modular lamp bases is relieved for about half of its inside length to accommodate the 1.4 inch reflector diameter and is fitted to the front.

An advantage of the present invention is that an extended-power arc lamp is provided.

Another advantage of the present invention is that an arc lamp is provided that can operate at 500 watts and still fits into standard modular lamp assemblies.

It is a further advantage of the present invention that a 500 watt arc lamp is provided that operates 150° C. cooler than comparable 300 watt arc lamps and has about twice the previous reflector area.

These and other objects and advantages of the present invention will no doubt become obvious to those of ordinary skill in the art after having read the following detailed description of the preferred embodiment which is illustrated in the drawing figure.

IN THE DRAWINGS

DETAILED DESCRIPTION OF THE PREFERRED EMBODIMENTS

Figure 1:
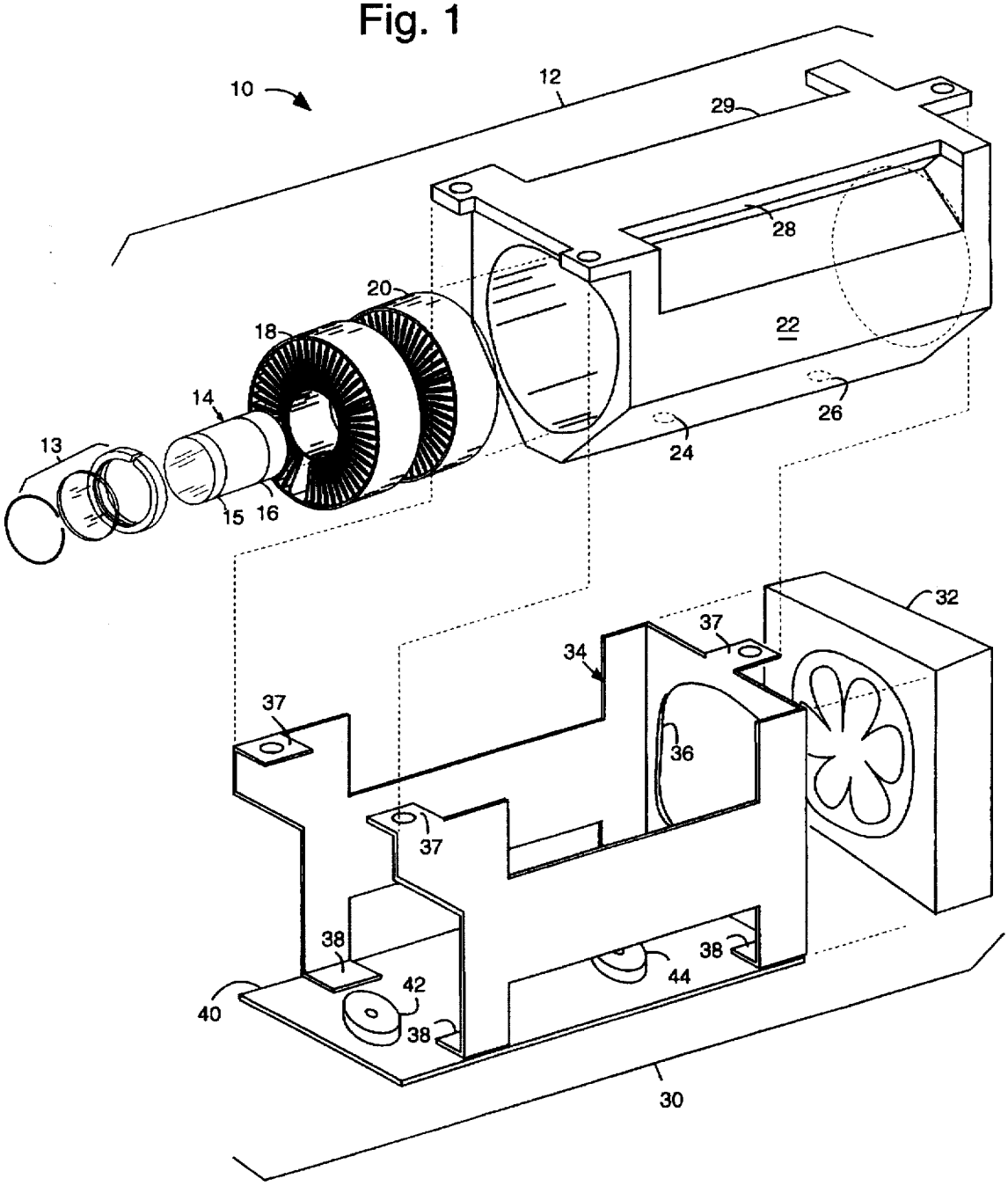
FIG. 1 is an exploded assembly view of a modular lamp assembly and its housing that was the subject of a prior patent application by the present inventor.
Figure 2:
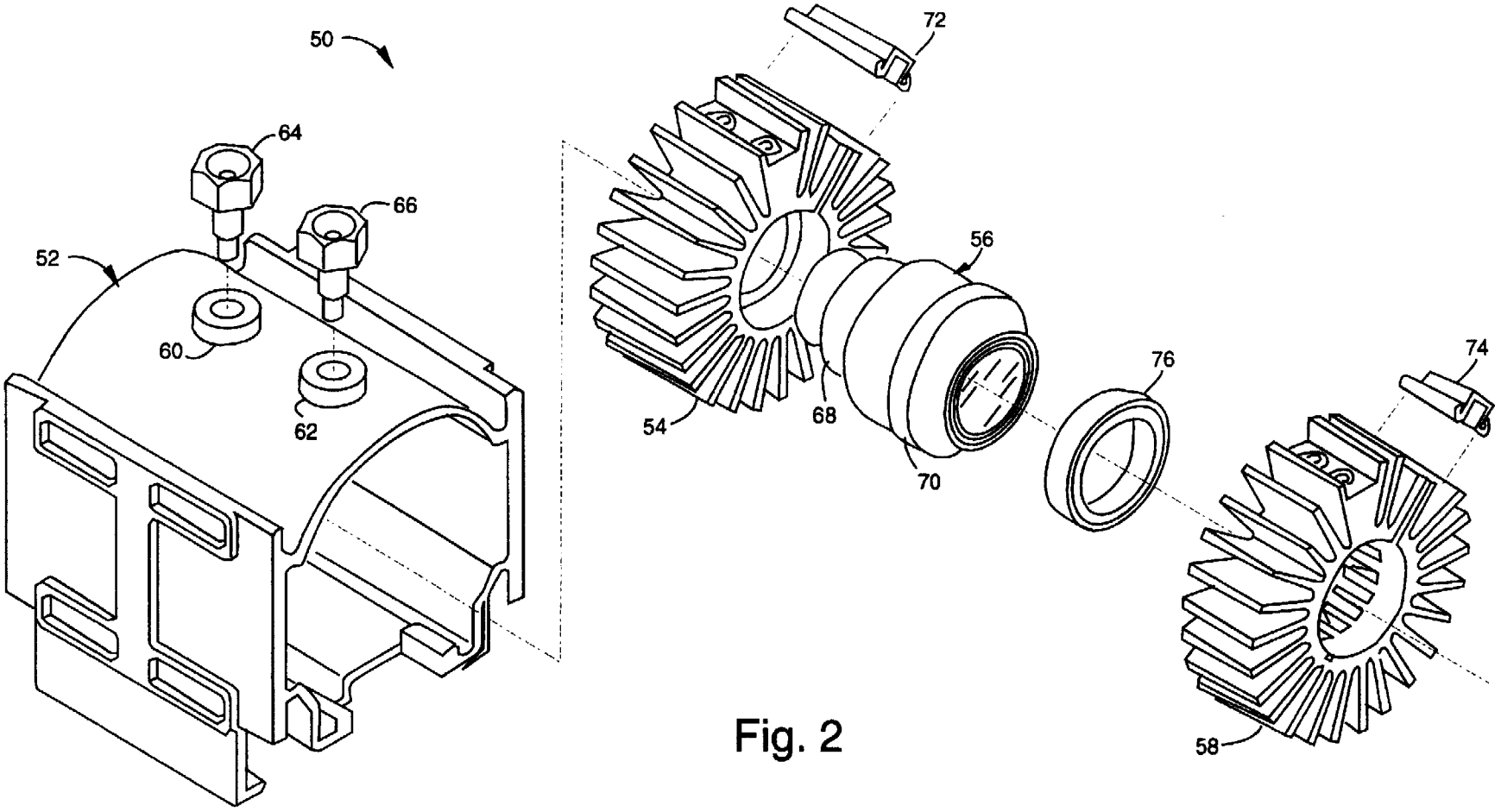
FIG. 2 is an exploded assembly view of a modular lamp assembly embodiment of the present invention that is compatible with the housing of FIG. 1.

FIG. 2 illustrates a modular lamp assembly embodiment of the present invention, referred to herein by the general reference numeral 50. The modular lamp assembly 50 may be used to replace assembly 12 in FIG. 1, and it comprises a molded plastic housing 52 that accepts an anode heat sink 54 attached to a focused lamp 56. A cathode heat sink 58 is attached to the front, light-emitting end of the lamp 56. Preferably, thermal compound is used to join the heat sinks 54 and 58 to the lamp 56, thus providing for lamps operated at 350–500 watts, e.g., the focused CERMAX lamps marketed by the present assignee, ILC Technology, Inc., (Sunnyvale, Calif.). A pair of locating holes 60 and 62 allow a pair of metal bolts 64 and 66 to respectively screw into and mechanically support the heat sinks 54 and 58. The pair of metal bolts 64 and 66 also serve as electrical terminals for the lamp assembly 50.

The anode heat sink 54 connects to a metal anode ring 68 that is mechanically snug to promote both efficient heat transfer and a good low-resistance electrical contact. The cathode heat sink 58 connects to a metal cathode ring 70, and it too is mechanically snug to promote both efficient heat transfer and a good low-resistance electrical contact. The body of the lamp 56 is ceramic and this functions as an insulator between the contact rings 68 and 70 which can have as much as 30,000 volts applied between them. The outside diameter of the body of the lamp 56 is larger than the outside diameter of the anode ring 68, thus creating a shoulder in the ceramic material against which the anode heat sink 54 is critically placed in intimate thermal contact.

The heat sinks 54 and 58 are split and a pair of spring clips 72 and 74 serve to close the respective splits in order to snug the heat sinks more firmly on the lamp 56. A heat transfer ring 76 provides a thermal bridge between the front window in the lamp 56 and the cathode heat sink 58. Such is required when the front window has a substantially smaller diameter than the body of the lamp 56.

Figure 3:
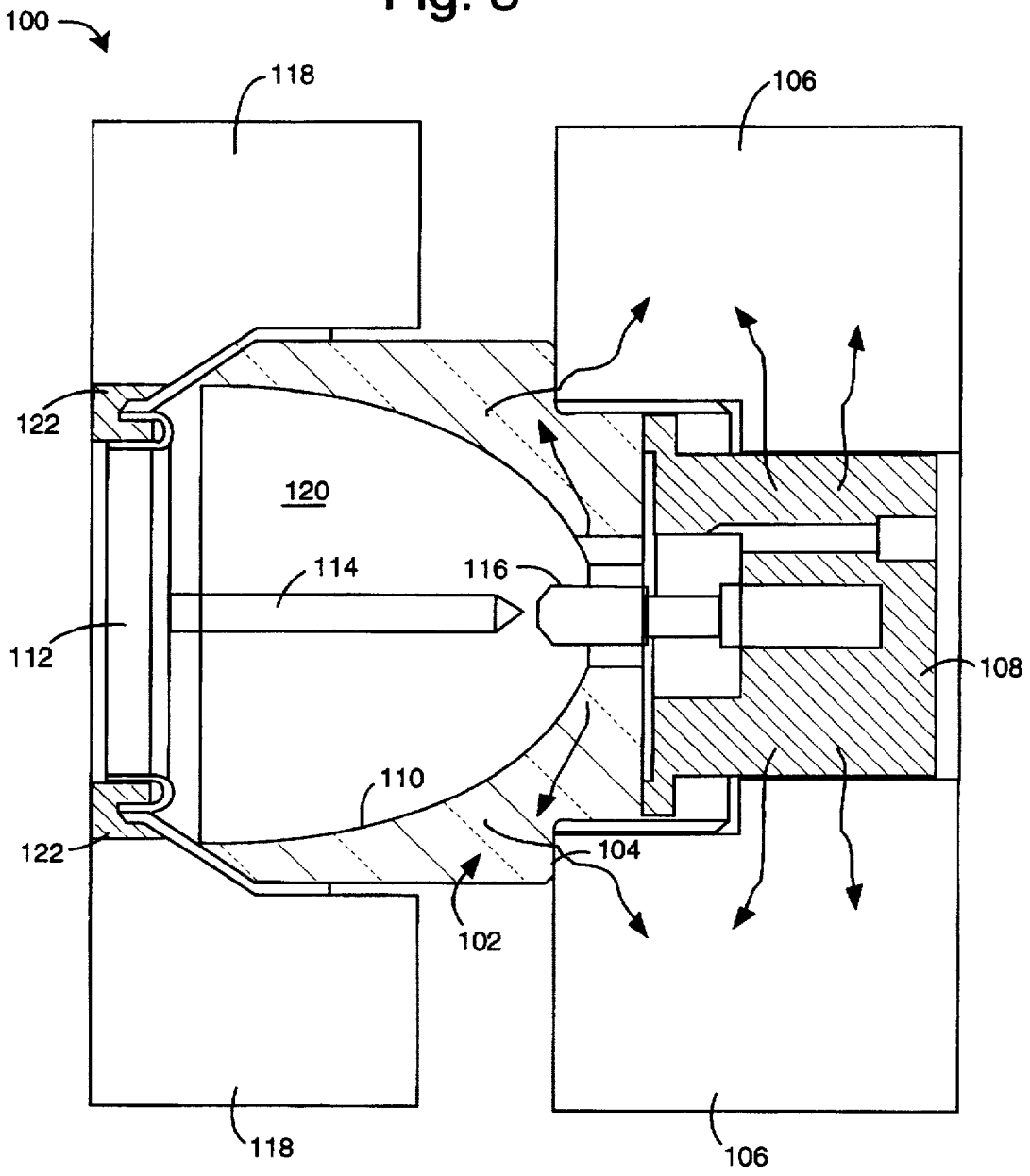
FIG. 3 is a cross sectional view of an arc lamp embodiment of the present invention such as is included in the modular lamp assembly of FIG. 2.

FIG. 3 illustrates an arc lamp embodiment of the present invention, referred to herein by the general reference numeral 100. The arc lamp 100 comprises a cylindrical ceramic body 102 that steps between different diameters at a ledge 104. Such ledge 104 allows heat from the ceramic body to flow both axially and radially into an anode heat sink 106. Preferably, the lamp 100 is operated at 500 watts, and has a base 108 so similar in dimensions to standardized plug-in modular 300 watt xenon arc lamps, as described in connection with FIG. 1, that the two can share the same heat sink 106. For example, the base 108 has a diameter of about one inch and the ledge 104 steps out to a diameter of 1.4 inches. Such larger diameters for the body 102 allow an elliptical reflector 110 to have a surface area about double that of one inch diameter xenon arc lamps. The lamp 100 further comprises a quartz window 112, a cathode 114 and an anode 116. A cathode heat sink 118 is similar to those used for standardized plug-in modular 300 watt xenon arc lamps, as described in connection with FIG. 1, but has been relieved for at least half of the length of its inside diameter to accommodate the larger 1.4 inch diameter of the body 102. A fan system is used to force an air stream axially through the heat sinks 106 and 118 and preferably provides twenty-five to thirty CFM of air flow.

The base 108 is preferably solid copper and the window 112 encloses a xenon atmosphere 120. A thermal and electrical contact ring 122 provides an electrical connection and a heat transfer bridge between the heat sink 118 and the cathode 114. The base 108 connects thermally and electrically to the anode 116. The wavy arrows illustrated in FIG. 3 moving through the body 102 and heat sink 106 represent at least some of the heat flow that begins at the reflector 110 and dissipates off the fins of the heat sinks 106 and 118. Tests indicate that although embodiments of the present invention can be operated at 500 watts, one hundred seventeen percent more than conventional 300 watt designs, the improved connection of the heat sink 106 to the body 102 and the doubled surface area of the reflector 110 result in operating temperatures that are reduced by about 150° C. This results even though the heat sinks and cooling air flow rates are basically the same as in prior art 300 watt modular lamp systems. Such lower temperatures are directly responsible for extended lamp lives that approach two thousand hours.

Although the present invention has been described in terms of the presently preferred embodiments, it is to be understood that the disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

What is claimed is:

1. An arc lamp system, comprising:

a cylindrical ceramic body in which an elliptical reflector is molded to have a diameter of about 1.4 inches, and each of a pair of ends have metal electrical contact rings, one for the anode and one for the cathode, wherein the body has two different diameters with a step in between at the middle that is formed into the ceramic and provides for a standardized anode heat sink for lesser-powered one inch modular lamp bases to be fitted to the base, and a standardized cathode heat sink for said lesser-powered one inch modular lamp bases is relieved for about half of its inside length to accommodate the 1.4 inch reflector diameter and is fitted to one of said ends.

2. A modular lamp assembly, comprising:

a molded-plastic housing with a pair of open ends and providing for a pair of electrical terminals that conduct external electrical power to an interior space within;

an anode heat sink with radial fins and having an outside circular diameter which will fit within a first end of said interior space of the molded-plastic housing and having an inside circular diameter, and which provides for electrical contact with a first of said pair of electrical terminals;

a cathode heat sink with radial fins and having an outside circular diameter which will fit within a second end of said interior space of the molded-plastic housing and having an inside circular diameter, and which provides for electrical contact with a second of said pair of electrical terminals;

a focused lamp having a cylindrical ceramic body and a light-emitting end with a reduced-diameter window that is associated with a metal cathode ring, and an opposite end with a base that is associated with a metal cathode ring, wherein said metal anode ring is fitted with said inside circular diameter of the anode heat sink and said metal cathode ring is fitted with said inside circular diameter of the cathode heat sink, and wherein each metal anode and cathode ring is in electrical and thermal contact with its respective anode and cathode heat sink; and a heat transfer ring which is positioned within the cathode heat sink to retain the focused lamp in a ring contact with said reduced-diameter window and providing a thermal bridge between said reduced-diameter window and the cathode heat sink;

wherein, said metal cathode ring has a substantially larger diameter than said metal anode ring and said cylindrical ceramic body steps out to a larger diameter immediately adjacent to said metal anode ring; and wherein, the cathode heat sink provides direct thermal conduction paths for heat to be transferred from all three of said base, said metal cathode ring and a face of said step in diameter of said cylindrical ceramic body.

3. A focused arc lamp, comprising:

a cylindrical ceramic body with a light-emitting end and a reduced-diameter window that is associated with a metal cathode ring, and an opposite end with a base that is associated with a metal cathode ring, wherein said metal anode ring provides for a fit with an inside circular diameter of an anode heat sink and said metal cathode ring provides for a fit with an inside circular diameter of a cathode heat sink, and wherein each metal anode and cathode ring is in electrical and thermal contact with its respective anode and cathode heat sink;

wherein, the cylindrical ceramic body and said reduced-diameter window provide for a heat transfer ring to be positionable within said cathode heat sink to retain said cylindrical ceramic body in a ring contact with said reduced-diameter window and which provides for a thermal bridge between said reduced-diameter window and said cathode heat sink;

wherein, said metal cathode ring has a substantially larger diameter than said metal anode ring and said cylindrical ceramic body steps out to a larger diameter immediately adjacent to said metal anode ring; and wherein, all three of said base, said metal cathode ring and a face of said step in diameter of said cylindrical ceramic body provide for simultaneous direct thermal conduction paths for heat to be transferred to said cathode heat sink.

* * * * *